US008196333B2

(12) United States Patent
Hopkins et al.

(10) Patent No.: US 8,196,333 B2
(45) Date of Patent: Jun. 12, 2012

(54) RAIL MOUNTABLE DIOPTER REAR SIGHT

(75) Inventors: David Brian Hopkins, Durham, NH (US); John Wilson, East Waterboro, ME (US)

(73) Assignee: Sig Sauer, Inc., Exeter, NH (US)

( * ) Notice: Subject to any disclaimer, the term of this patent is extended or adjusted under 35 U.S.C. 154(b) by 301 days.

(21) Appl. No.: 12/798,599

(22) Filed: Apr. 7, 2010

(65) Prior Publication Data

US 2011/0247257 A1 Oct. 13, 2011

(51) Int. Cl.
*F41G 1/00* (2006.01)

(52) U.S. Cl. ..... 42/133; 42/136

(58) Field of Classification Search ..... 42/133, 42/136, 140, 111
See application file for complete search history.

(56) References Cited

U.S. PATENT DOCUMENTS

| | | | | |
|---|---|---|---|---|
| 982,151 | A * | 1/1911 | Marble | 42/133 |
| 2,671,966 | A * | 3/1954 | Jacobsen et al. | 42/137 |
| 6,481,146 | B2 * | 11/2002 | Carrier, III | 42/136 |
| 6,615,530 | B2 * | 9/2003 | Johansson | 42/133 |
| 7,726,229 | B2 * | 6/2010 | Schwerman et al. | 89/41.17 |
| 2003/0140546 | A1 * | 7/2003 | Kay | 42/133 |
| 2005/0072035 | A1 * | 4/2005 | McClimond | 42/133 |

* cited by examiner

*Primary Examiner* — J. Woodrow Eldred
(74) *Attorney, Agent, or Firm* — Bennet K. Langlotz; Longlotz Patent & Trademark Works, Inc.

(57) ABSTRACT

A rail mountable diopter rear sight has a housing, a drum arm pivotably connected to the housing, a sight drum rotatably engaged with the drum arm, and elevation adjustment screw connected to the drum arm and the sight drum. The sight drum rotates on a common axis with the elevation adjustment screw. The sight drum threadedly engages a threaded portion of the elevation adjustment screw.

24 Claims, 7 Drawing Sheets

RAIL MOUNTABLE DIOPTER REAR SIGHT

FIELD OF THE INVENTION

The present invention relates to a rail mountable diopter rear sight that provides an optimum sighting system for both close quarters battle and medium to long-range engagements.

BACKGROUND OF THE INVENTION

Rail mountable diopter rear sights are desirable for their ability to provide an optimum sighting system for both close quarters battle and medium to long range engagements. Close Quarters Battle (CQB) is a type of fighting in which small units engage the enemy with personal weapons at very short range, potentially to the point of hand-to-hand combat. CQB is defined as a short-duration, high-intensity conflict, characterized by sudden violence at close range.

In contrast, medium to long-range engagements are typically lower intensity and require accurate sighting of objects at greater distances. In these circumstances, the downward acceleration on the projectile imparted by gravity is of greater significance. The effect of gravity on a projectile in flight is often referred to as bullet drop because it causes the bullet to drop from the shooter's line of sight. For accuracy at longer distances, the sighting components of a gun must compensate for the effect of bullet drop.

To accommodate such users, rotating four position drum sights have been developed wherein an aperture is present at each position. The height of the apertures is calibrated to compensate for bullet drop at particular distances, such as 100-400 m. However, many of these devices suffer from the need for a locating screw to calibrate the drum sights' elevation that is separate from the pin that enables rotation of the drum sights. Furthermore, a separate tool is typically required to adjust the locating screw, and such a tool may not be available in the field. In addition, the calibration screw systems traditionally employed are complex, with small moving parts that are subject to damage and improper adjustment under harsh field conditions.

Therefore, a need exists for a new and improved rail mountable diopter rear sight that provides an optimum sighting system for both close quarters battle and medium to long-range engagements. In this regard, the various embodiments of the present invention substantially fulfill at least some of these needs. In this respect, the rail mountable diopter rear sight according to the present invention substantially departs from the conventional concepts and designs of the prior art, and in doing so provides an apparatus primarily developed for the purpose of providing an optimum sighting system for both close quarters battle and medium to long-range engagements.

SUMMARY OF THE INVENTION

The present invention provides an improved rail mountable diopter rear sight, and overcomes the above-mentioned disadvantages and drawbacks of the prior art. As such, the general purpose of the present invention, which will be described subsequently in greater detail, is to provide an improved rail mountable diopter rear sight that has all the advantages of the prior art mentioned above.

To attain this, the preferred embodiment of the present invention essentially comprises a housing, a drum arm pivotably connected to the housing, a sight drum rotatably engaged with the drum arm, and elevation adjustment screw connected to the drum arm and the sight drum. The sight drum rotates on a common axis with the elevation adjustment screw. The sight drum threadedly engages a threaded portion of the elevation adjustment screw.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
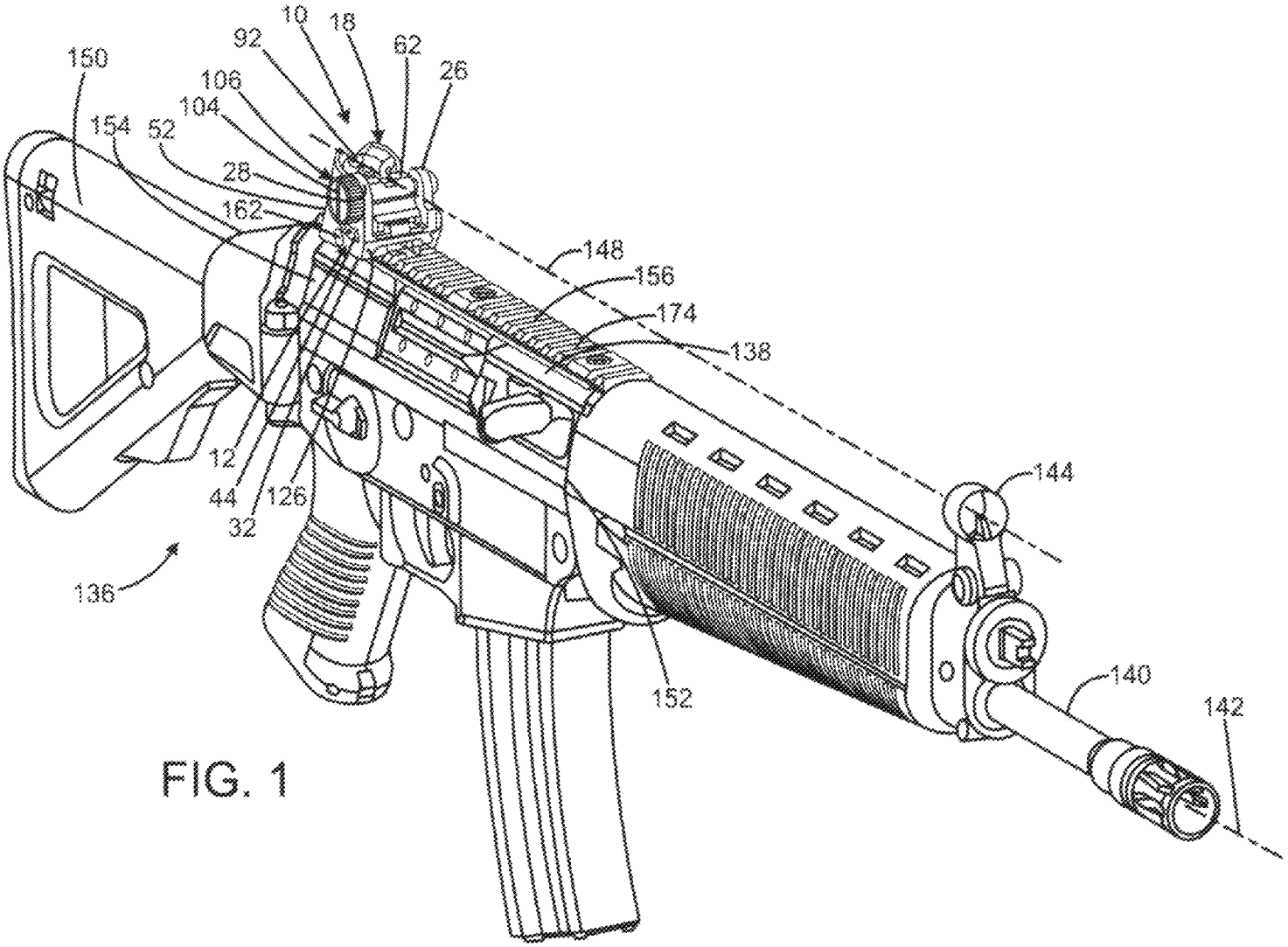
FIG. 1 is a front perspective view of the current embodiment of the rail mountable diopter rear sight constructed in accordance with the principles of the present invention.

A preferred embodiment of the rail mountable diopter rear sight of the present invention is shown and generally designated by the reference numeral 10.

FIG. 1 illustrates improved rail mountable diopter rear sight 10 of the present invention. More particularly, the diopter rear sight is shown in use attached to a rifle 136. The rifle has an upper receiver 138 with an accessory rail 156 and a barrel 140 defining a barrel axis 142 protruding from the front 152 of the upper receiver. A butt stock 146 extends from the rear 154 of the upper receiver and has cheek weld surfaces 150 on its opposing sides.

The diopter rear sight has a sight housing 12 with a right clamp arm 126 and movable clamp 132 (visible in FIG. 2) attached to its bottom 32. The right clamp arm and clamp enable the diopter rear sight to be connected to the accessory rail attached to the top of the upper receiver. A drum arm 16 is pivotally connected to the sight housing 12. A sight drum 18 is rotatably connected to the drum arm. An elevation screw 14 is threadedly attached to the sight drum and adjusts the sight drum's elevation. The diopter rear sight is compatible with the rifle's existing front sight 144.

Figure 2:
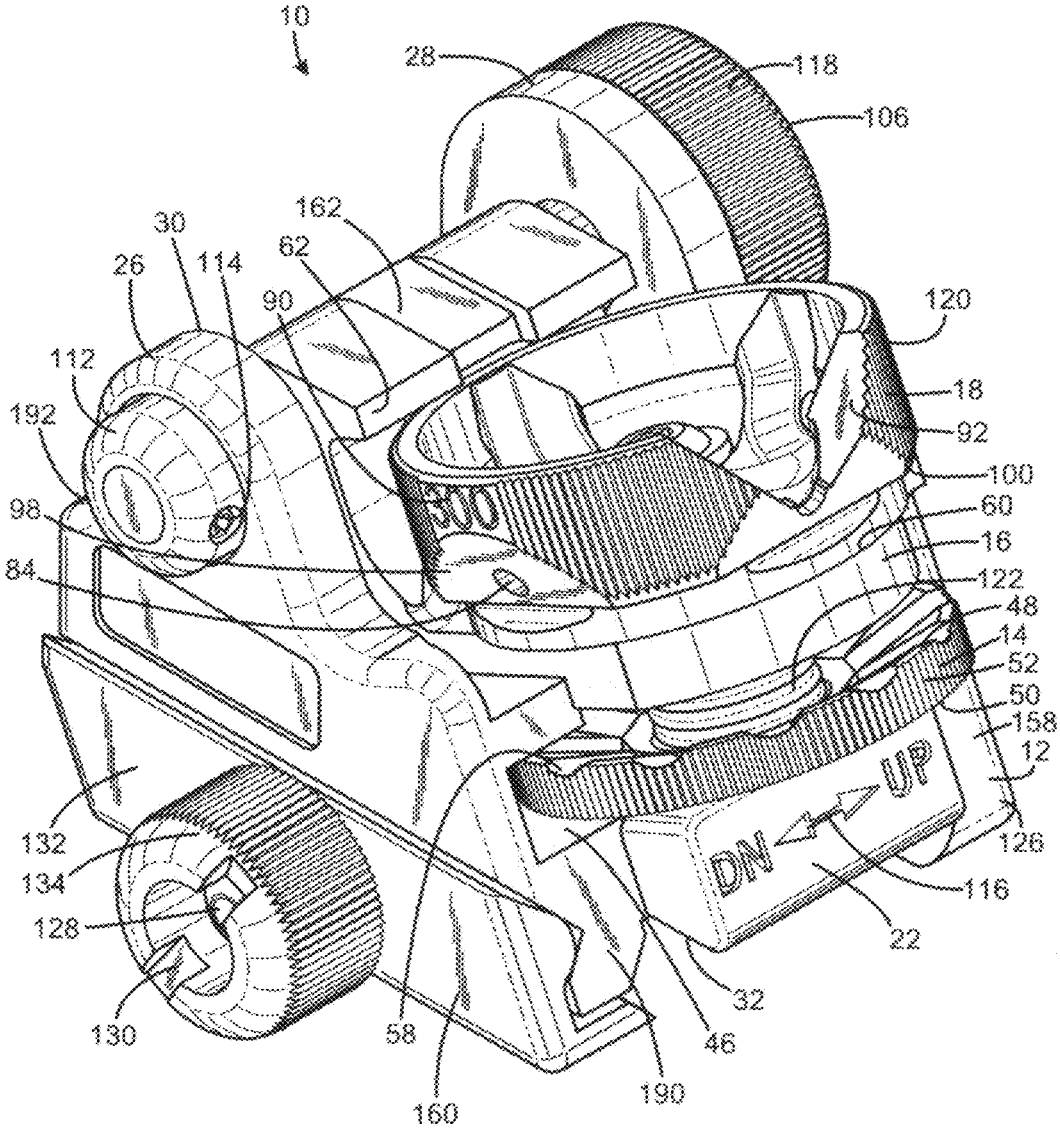
FIG. 2 is a rear perspective view of the current embodiment of the rail mountable diopter rear sight of the present invention.

FIG. 2 illustrates the rear 190 of the present invention. More particularly, the diopter rear sight has a sight drum 18 that is rotatably and threadedly mounted on one end of an elevation screw 14. The sight drum has a V notch 92 and first, second, and third pinhole apertures 80, 82, and 84 positioned at 90° intervals around its outer perimeter 120. The bottom 100 of the sight drum rests against the top surface 60 of a drum arm 16. The drum arm is pivotably attached to the sight housing by a windage screw 106 and is held above the elevation screw by a range spring 122.

The clamping action of the diopter rear sight to an accessory rail on a rifle is accomplished by rotating a clamp nut 134 clockwise on a clamp screw 128 to tighten the clamp against the accessory rail. The clamp screw is exposed between the clamp and the right clamp arm, which enables the clamp screw to engage one of the cross slots 174 present in the accessory rail. The clamp nut is rotated counterclockwise to permit the diopter rear sight to be disengaged from the accessory rail. The clamp nut has a knurled outer perimeter to enhance its ability to be gripped by the user. A coin slot 130 in the clamp nut also enables a United States quarter and similar coins to be used to rotate the clamp nut. The clamp nut end of the clamp screw is staked to prevent the removal of the clamp nut from the clamp screw. In the current embodiment, the diopter rear sight should be mounted with the center of the clamp nut located 1 inch (25 mm) from the rear of the accessory rail.

Figure 3:
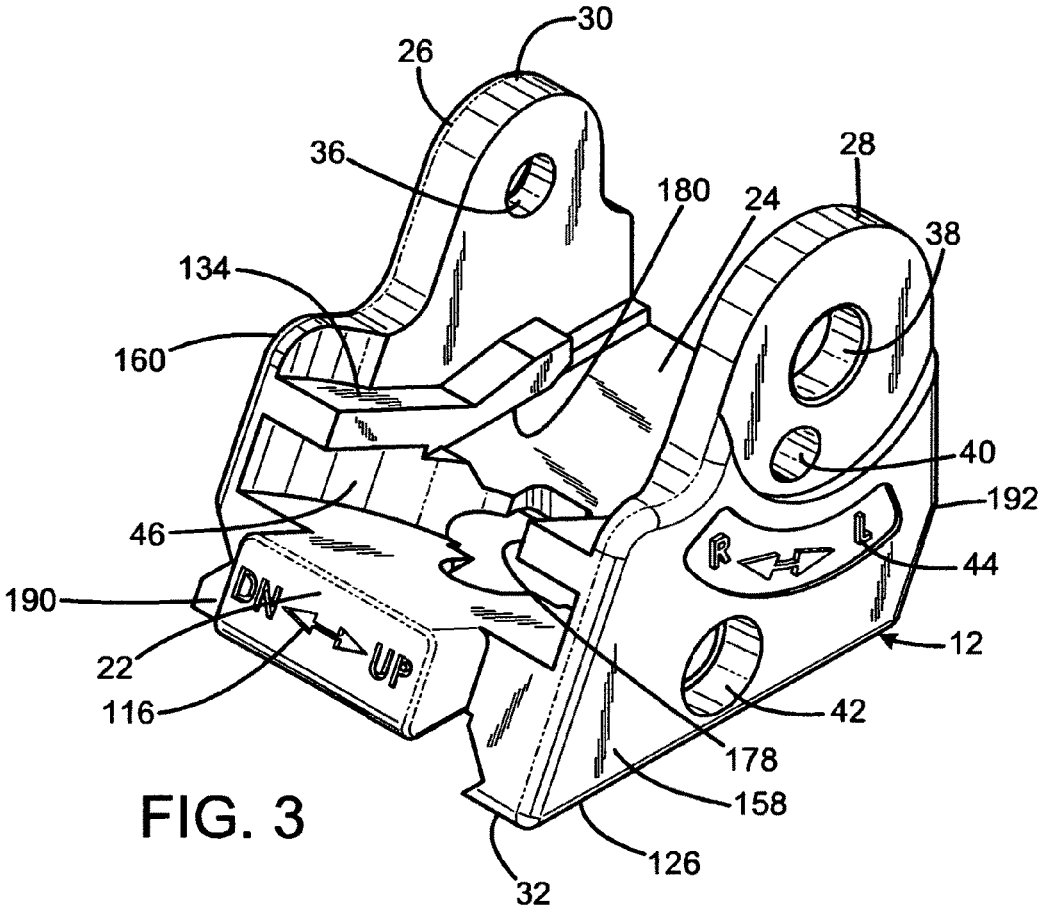
FIG. 3 is a top perspective view of the current embodiment of the sight housing of the present invention.

FIG. 3 illustrates the sight housing 12 of the present invention. More particularly, the sight housing is made of injection-molded steel in the current embodiment. The top 30 of the right side 158 of the sight housing terminates in a second ear 28. The second ear has a windage plunger hole 40 and a second windage screw hole 38 in it. The windage plunger hole is positioned below the second windage screw hole.

The top 30 of the left side 160 of the sight housing terminates in a first ear 26. The first ear has a first windage screw hole 36 in it. The first windage screw hole is coaxial with the second windage screw hole, but has a smaller diameter in the current embodiment.

The left and right sides of the sight housing are joined by a rear base 22 at their rear 190 and a front base 24 at their front 192. The front base and rear base are separated by an elevation screw slot 46 defined by the left and right sides of the sight housing that receives the elevation screw 14.

Two drum arm stop ledges 134 protrude inwards from the left and right sides and extend rearward from where the rear base joins the first and second ears. The surfaces of these ledges provide stops that limit the rotation of the drum arm to prevent unlimited elevation adjustment of the sight drum. The stops provide positive surface stops for all combinations of elevation and windage settings, keeping the sight drum and drum arm assembly from over traveling its limits.

Elevation spring slots 180 are defined in the left and right sides of the sight housing as two channels separating the front base 24 from the drum arm stop ledges 134 at the front 192 of the sight housing.

The rear of the rear base has elevation rotation indicia 116 on it. The elevation rotation indicia indicate to the user to rotate the elevation screw clockwise to lower the drum arm and to rotate it counterclockwise to raise the drum arm.

The right clamp arm 126 extends from the bottom of the right side of the sight housing. A clamp screw hole 42 in the right clamp arm receives one end of the clamp screw 128. The clamp screw hole is sized appropriately to receive the knurled clamp screw head 162 to create a press fit.

Windage rotation indicia 44 are located above the clamp screw hole. The windage rotation indicia indicate to the user to rotate the windage screw 106 clockwise to shift the drum arm 16 to the right and to rotate the windage screw 106 counterclockwise to shift the drum arm to the left.

Figure 4:
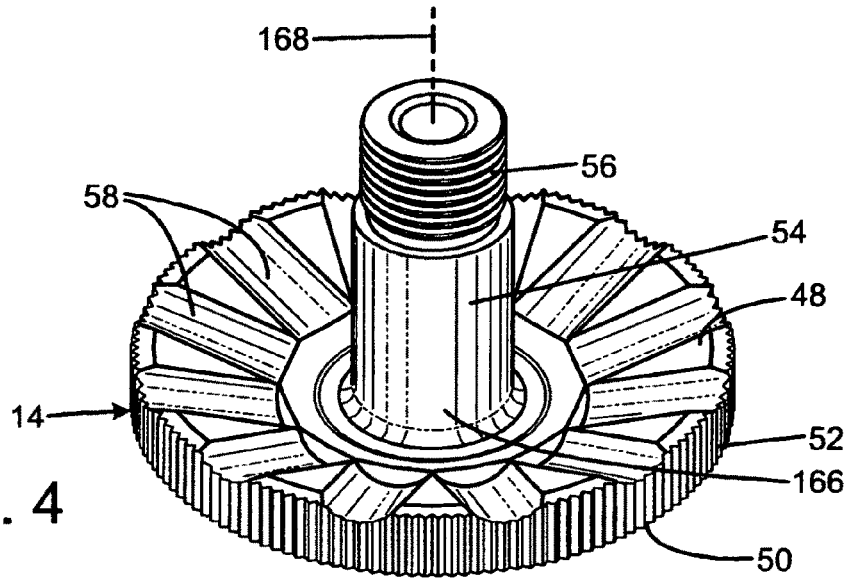
FIG. 4 is a top perspective view of the current embodiment of the elevation screw of the present invention.

FIG. 4 illustrates the elevation screw 14 of the present invention. More particularly, the elevation screw, which is made of injection-molded steel in the current embodiment, has a knurled outer perimeter 52 to facilitate the user's ability to rotate it. The elevation screw is of unitary construction, with a top surface 48 and an elevation shaft 54. The concave top surface of the elevation screw has twelve detents 58 in the current embodiment. The elevation shaft 54 has one end attached to the center of the top surface of the elevation screw and protrudes upward. The elevation shaft receives the range spring 122 around its smooth base and terminates in a threaded portion 56. The convex bottom surface 50 of the elevation screw rests against the rear base 22 of the sight housing 12 but is free to slide from side to side to permit windage adjustment of the drum arm 16 and to pivot to permit elevation adjustment of the drum arm 16. The elevation screw has an axis of rotation 168 about the elevation shaft.

Figure 5:
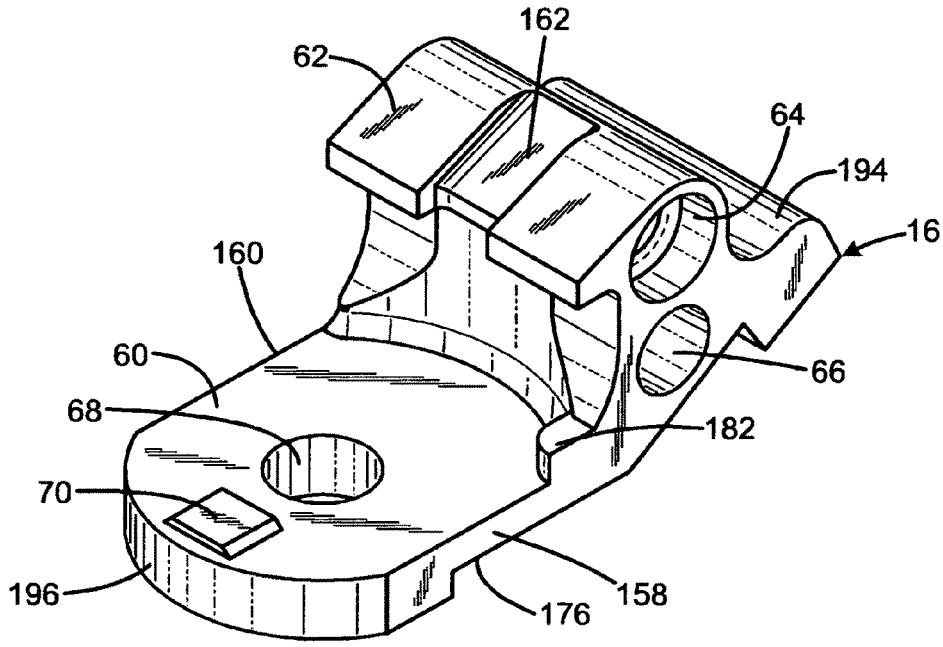
FIG. 5 is a top perspective view of the current embodiment of the drum arm of the present invention.

FIG. 5 illustrates the drum arm 16 of the present invention. More particularly, the drum arm 16, which is made of injection-molded steel in the current embodiment, has a top surface 60 and a bottom surface 176. The top surface has an elevation screw hole 68 in it. A detent engagement element 70 protrudes upward from its rear 196, and a drum stop 182 protrudes upward from its right side 158. The elevation screw hole 68 receives the smooth base portion 166 of the elevation screw 14. The bottom surface defines a counter bore that receives a portion of a range spring 122.

A portion of the front 194 of the drum arm protrudes upward to form an overhang 62. The middle of the top of the overhang forms a notch 162 that facilitates sighting a target. A windage screw passage 64 extends through both sides of the overhang beneath the notch. A windage plunger channel 66 opens to the right side 158 below the windage screw passage 64.

Figure 6:
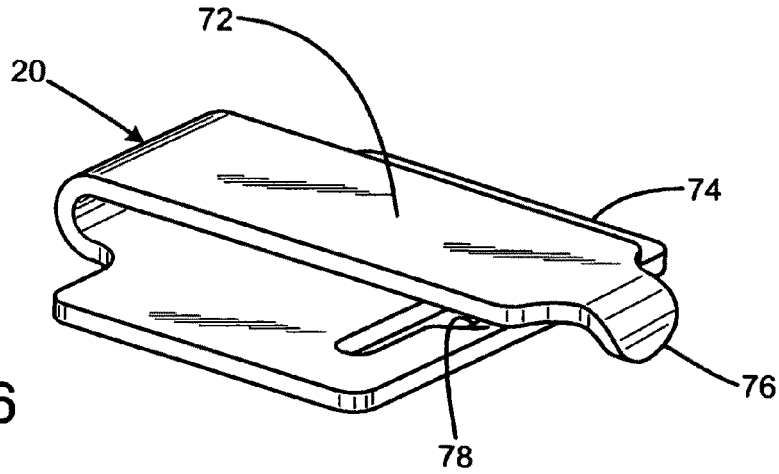
FIG. 6 is a top perspective view of the current embodiment of the elevation spring of the present invention.

FIG. 6 illustrates the elevation spring 20 of the present invention. More particularly, the elevation spring, which is made of spring steel in the current embodiment, is a leaf spring having an upper portion 72 and a closely-spaced parallel lower portion 74 that are joined in a U-shaped bend at one end. The free end of the lower portion has a tab 78 protruding from it. The tab clips to a recess 178 in the rear 190 of the front base 24 of the sight housing 12 to secure the elevation spring to the sight housing. The elevation spring slots 180 receive the lower portion of the elevation spring.

The free end of the upper portion terminates in a detent engagement element 76. The detent engagement element 76 engages with the detents 58 in the top surface 48 of the elevation screw 14. The detent engagement element 76 holds the bottom surface 50 of the elevation screw against the rear base 22 of the sight housing 12. The detent engagement element 76 also provides a click stop action that enables a limited but useful range of motion of the elevation screw as it is rotated to adjust the height of the drum arm 16 with respect to the sight housing 12, thereby altering the angle between the user's line of sight 148 through the diopter rear sight and the barrel axis 142. The drum arm rises one quarter of the pitch of the threaded portion 56 of the elevation screw 14 for each quarter turn of the elevation screw.

Specifically, when the diopter rear sight is mounted on the SIG556® semi automatic rifle with a 16 inch barrel and long gas system manufactured by SIG SAUER® of Exeter, N.H., each click in elevation is a 0.5 minute of angle adjustment. In this circumstance, the elevation screw provides a total elevation calibration adjustment of 25 inches (0.64 m) at 100 m. When the diopter rear sight is mounted on the SIG556® semi automatic rifle with a 10 inch barrel manufactured by SIG SAUER® of Exeter, N.H., each click in elevation is a 0.6 minute of angle adjustment. In this circumstance, the elevation screw provides a total elevation calibration adjustment of 34 inches (0.87 m) at 100 m.

Figure 7:
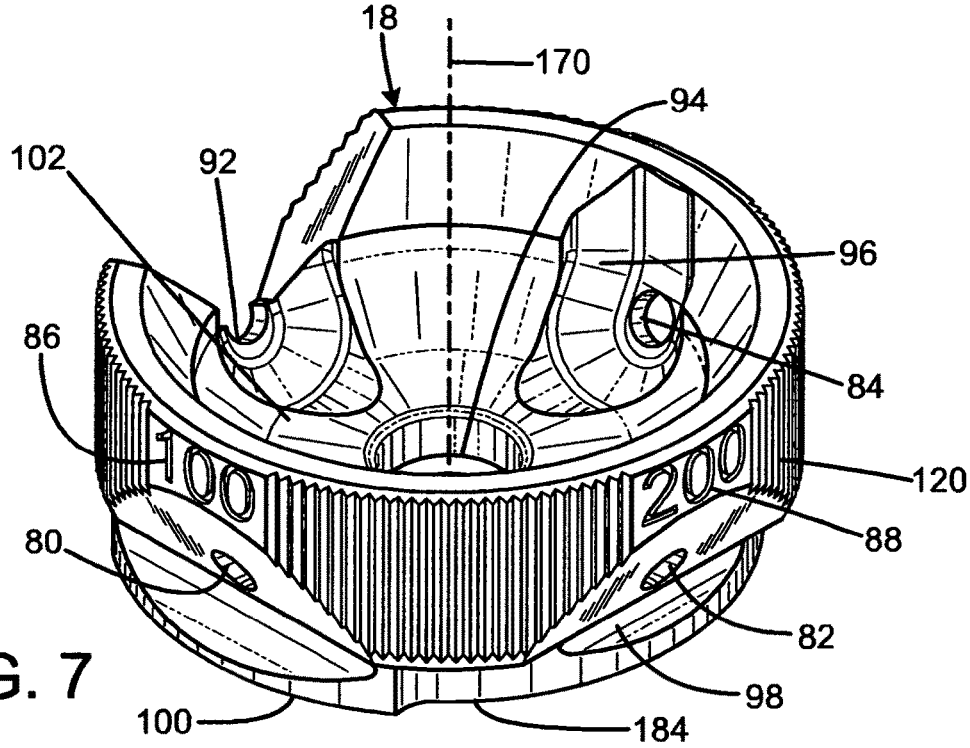
FIG. 7 is a top perspective view of the current embodiment of the sight drum of the present invention.

FIG. 7 illustrates the sight drum 18 of the present invention. More particularly, the sight drum, which is made of injection-molded steel in the current embodiment, is generally cylindrical in shape with an open top. Its outer perimeter 120 is knurled to facilitate its rotation by the user. The sight drum has an axis of rotation 170. Four outer recesses 98 and four inner recesses 96 are positioned in pairs on opposite sides of the outer perimeter at 90° intervals. A V notch 92 is present in one pair of recesses. A first aperture 80, second aperture 82, and third aperture 84 are divided between the remaining recesses. The outer recesses and inner recesses enable the apertures to be clean and sharp. The inner recesses remove material from the sight drum so the apertures have minimal thickness. The outer recesses provide a flat surface that is normal to the shooter's eye so the corresponding aperture is a true circle in shape.

The V notch and apertures provide four sight stations that compensate for bullet drop over different distances because they are at different heights relative to the front sight above the barrel axis. The V notch is intended for Close Quarters Battle, whereas the apertures are used for targets at longer distances. In the current embodiment, the apertures are zeroed for targets at 100, 200, and 300 m. Indicia are provided to identify the sight stations (indicium 86 for 100 m and indicium 88 for 200 m are visible in FIG. 7, and indicium 90 for 300 m is visible in FIG. 2). All four sight stations are calibrated at once by properly sighting in any one of the apertures because their relative positions can be determined by ballistics data for the ammunition to be employed. However, it is believed that the most accurate results are achieved by sighting in at the furthest range available, preferably 300 m. In the current embodiment, the diopter rear sight has been optimized for M855 (NATO SS109) and M193 ammunition.

When the diopter rear sight is mounted on the SIG556® semi automatic rifle with a 16 inch barrel and long gas system manufactured by SIG SAUER® of Exeter, N.H., the V notch provides a point-blank range of 237 m with a +/−2.5 inches (+/−63 mm) margin. When the diopter rear sight is mounted on the SIG556® semi automatic rifle with a 10 inch barrel manufactured by SIG SAUER® of Exeter, N.H., the V notch provides a point-blank range of 227 m with a +/−3 inches (+/−75 mm) margin.

Figure 8:
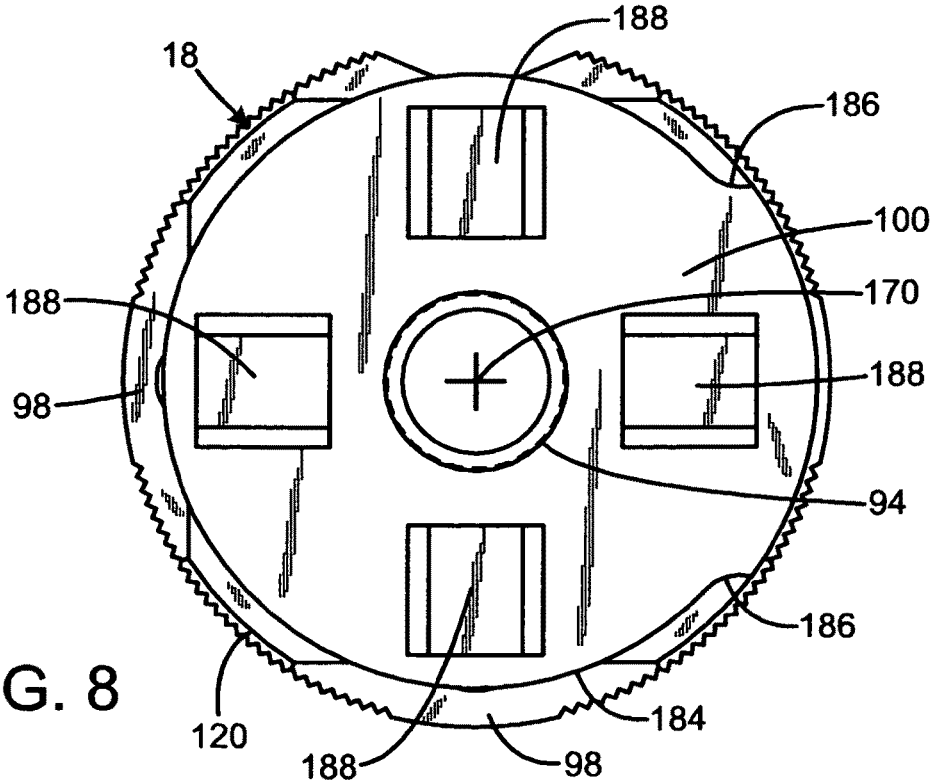
FIG. 8 is a bottom view of the current embodiment of the sight drum of the present invention.

FIG. 8 illustrates the bottom 100 of the sight drum 18 of the present invention. More particularly, an elevation screw hole 94 is located in the middle of the sight drum. The elevation screw hole 94 threadedly receives the threaded portion 56 of the elevation screw 14 after the threaded portion passes through the elevation screw hole 68 in the drum arm 16. Four detents 188 are positioned on the bottom separated by 90° intervals. The detents 188 are aligned with the centers of the apertures so that when a detent 188 is engaged by the detent engagement element 70 on the drum arm 16, the corresponding aperture or V notch is aligned with the user's line of sight 148. This provides a click stop action that enables a limited but useful range of motion of the sight drum as it is rotated to adjust the sight station presented to the user to compensate for bullet drop at different distances.

The drum does not rotate freely and is constrained from going past the first and fourth sight stations (the V notch and the third aperture). The drum stop 182 on the drum arm 16 rides in a clearance groove 184 along the circumference of the drum on the drum's bottom. The clearance groove is interrupted on either side of the first aperture at 186, which prevents further rotation of the drum by contacting the drum stop 182.

Figure 9:
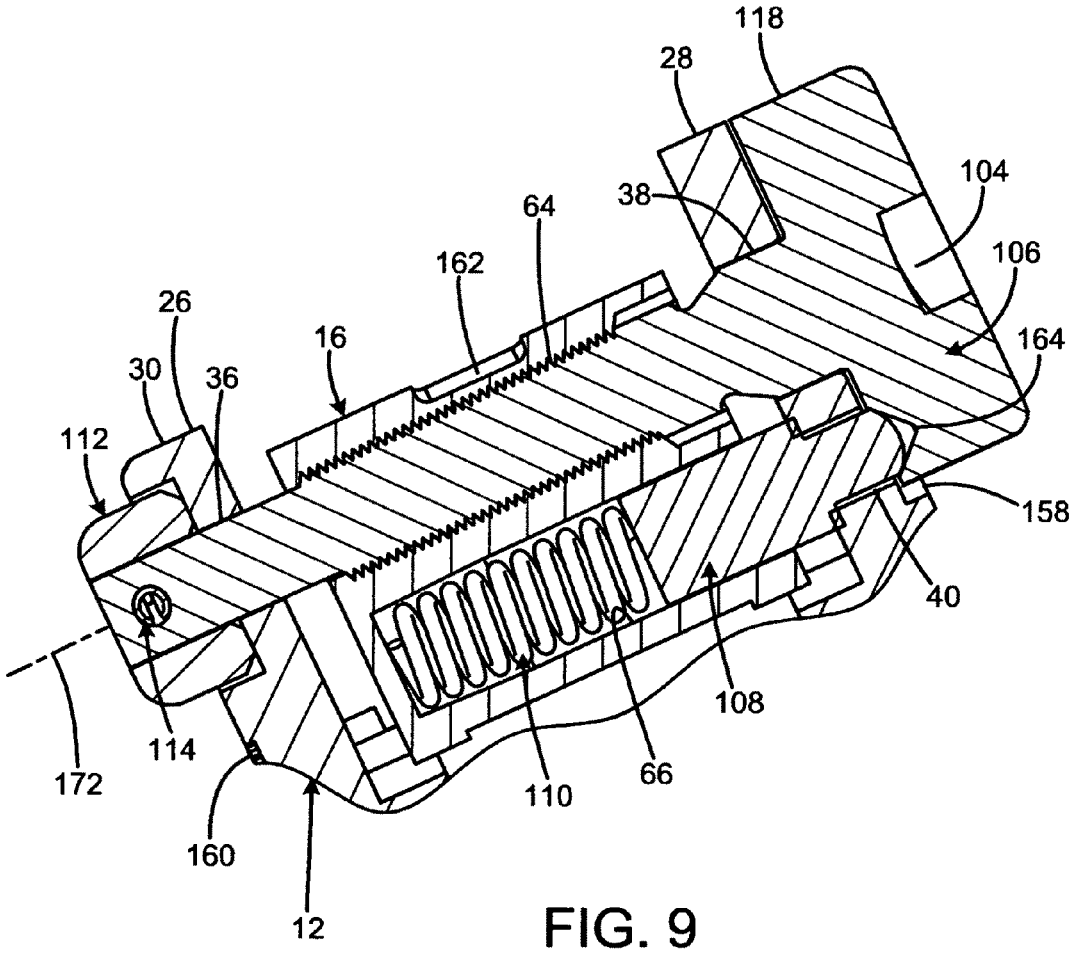
FIG. 9 is a rear sectional view of the current embodiment of the drum arm of the present invention.

FIG. 9 illustrates the drum arm 16 of the present invention with its rear cutaway. More particularly, it is apparent that the windage screw 106 protrudes from the right side 158 of the sight housing 12. The windage screw 106 has one end inserted through the second windage screw hole 38 in the second ear 28 and the first windage screw hole 36 in the first ear 26. The windage screw also passes through the windage screw passage 64. The different diameters of the screw holes and the varying diameter of the windage screw prevent the windage screw from being inserted from the left side 160 of the sight housing 12. A windage cap 112 is secured to the end of the windage screw protruding from the first windage screw hole by a windage cap pin 114. The windage cap prevents the windage screw from being inadvertently removed from the windage screw passage and the windage screw holes.

The outer perimeter 118 of the windage screw is knurled to facilitate its rotation by the user. The windage screw has an axis of rotation 172. The right surface of the windage screw has a coin slot 104 that also enables a United States quarter and similar coins to be used to rotate the windage screw. Eight detents 164 are present in the left surface of the windage screw.

A windage spring 110 and windage plunger 108 are placed within the windage plunger channel 66. One end of the windage plunger protrudes from the windage plunger channel through the windage plunger hole 40 in the second ear. The end of the windage plunger protruding from the windage plunger hole is biased by the windage spring to engage with the detents 164 in the windage screw. This provides a click stop action that enables a limited but useful range of motion of the windage screw as it is rotated to adjust the lateral position of the drum arm 16 with respect to the sight housing 12. When the drum arm moves, the sight drum and its apertures also move with the lateral translation of the drum arm, thereby altering the angle between the user's line of sight 148 through the diopter rear sight and the barrel axis 142. The windage plunger bottoms out against the inside of the right ear on the site housing, constantly biasing the drum arm to the left of the windage screw threads. The tip of the plunger extends through the right ear of the housing to act with the detents on the windage screw while the entire drum arm remains under spring pressure.

Specifically, when the diopter rear sight is mounted on the SIG556® semi automatic rifle with a 16 inch barrel and long gas system manufactured by SIG SAUER® of Exeter, N.H., each click in traverse is a 0.5 minute of angle adjustment. In this circumstance, the windage screw provides a total windage calibration adjustment of 34 inches (0.87 m) at 100 m. When the diopter rear sight is mounted on the SIG556® semi automatic rifle with a 10 inch barrel manufactured by SIG SAUER® of Exeter, N.H., each click in traverse is a 0.6 minute of angle adjustment. In this circumstance, the windage screw provides a total windage calibration adjustment of 43 inches (1.1 m) at 100 m.

Figure 10:
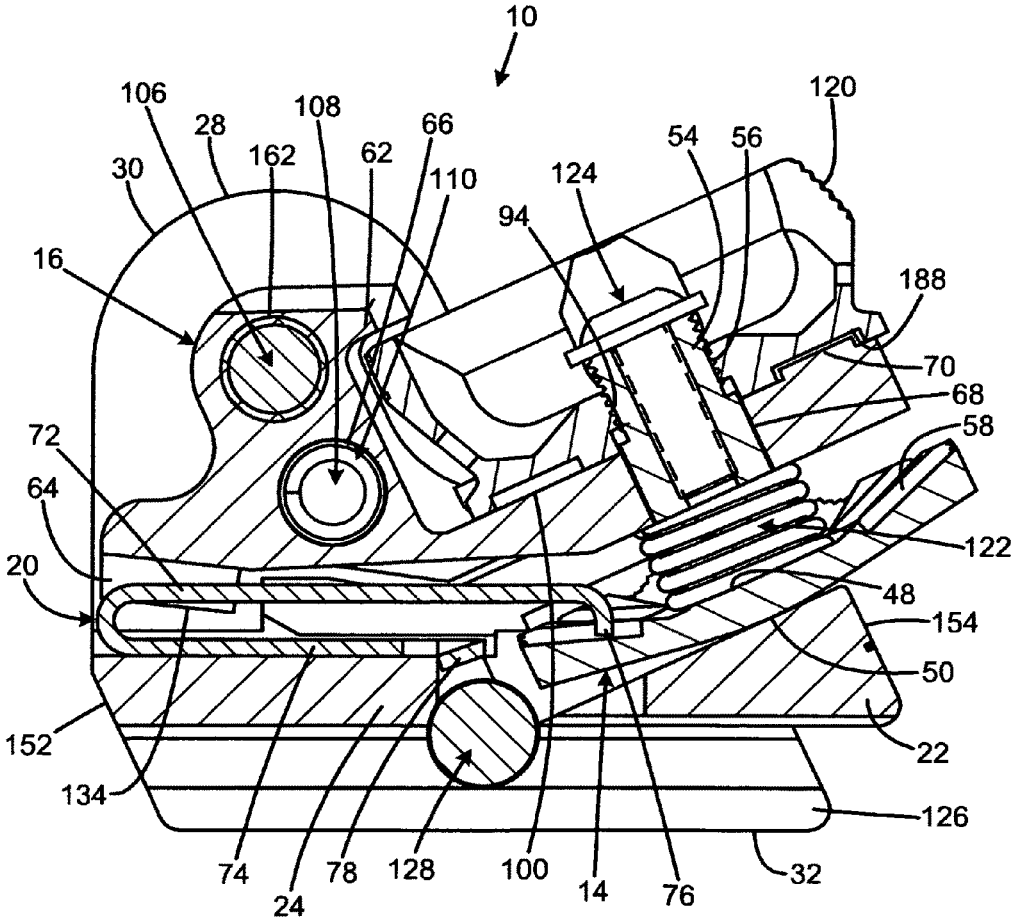
FIG. 10 is a left side sectional view of the current embodiment of the rail mountable diopter rear sight of the present invention.

FIG. 10 illustrates the rail mountable diopter rear sight 10 of the present invention with the left side of the sight housing 12 cutaway. The clamp screw 128 is inserted through the clamp screw hole 42 in the right clamp arm 126 of the sight housing.

The bottom surface 50 of the elevation screw 14 rests against the rear base 22. The lower portion 74 of the elevation spring 20 rests against the front base 24 between the drum arm stop ledges 134 so that the detent engaging element 76 of its upper portion 72 can engage with the detents 58 on the top surface 48 of the elevation screw.

The drum arm 16 is held above the top surface of the elevation screw by the range spring 122. The range spring 122 is a compression coil spring that encircles the base of the elevation shaft 54. The smooth base portion 166 of the elevation shaft 54 passes through the elevation screw hole 68 in the drum arm, and the threaded portion 56 is threadedly connected to the elevation screw hole 94 in the sight drum 18. The elevation screw stop 124 is attached to the end of the threaded portion.

The spring forces between the range and elevation spring are arranged so they allow the range to be adjusted on the drum without inadvertently changing the elevation calibration by rotating the elevation screw. The windage spring and plunger, as well as the range and elevation spring, all work together to keep the aperture constantly biased in one direction, stabilizing and securing the site drum from movement during use.

The sight drum 16 is positioned so that its bottom rests against the top surface 60 of the drum arm. This enables the detent engagement element 70 on the rear 196 of the drum arm to engage with the detents 188 on the bottom of the sight drum. The drum arm is urged upwards by the range spring, which compresses to allow the sight drum to ride up over the detent engagement element 70 on the drum arm.

The drum arm is pivotably connected to the first ear 26 and second ear 28 of the sight housing by the windage screw 106. The overhang 62 on the drum arm prevents the drum sight from being lifted upwards from the drum arm, which prevents disassembly during use. Instead, the elevation screw must be removed from below so that the drum sight can slide out rearwardly from the drum arm.

When the shooter is in the shooting position with his cheek against one of the rifle's cheek weld surfaces 150, his line of sight 148 is aligned with the rearmost sight station. In the event the target is at a different distance than the one the rearmost sight station is optimized for, the user rotates the sight drum to change which sight station is rearmost. Once the optimal sight station is rearmost, the shooter aims through that sight station.

While a current embodiment of the rail mountable diopter rear sight has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A diopter rear sight comprising:

a housing;

a drum arm pivotably connected to the housing;

a sight drum rotatably engaged with the drum arm;

an elevation adjustment screw connected to the drum arm and the sight drum;

wherein the sight drum rotates on a common axis with the elevation adjustment screw.

2. The diopter rear sight of claim 1, further comprising:

the elevation adjustment screw having a threaded portion with a plurality of threads having a pitch and a top surface; and wherein the sight drum threadedly engages the threaded portion of the elevation adjustment screw.

3. The diopter rear sight of claim 2, wherein responsive to the elevation screw turning one quarter turn about its axis, a distance between the drum arm and the top surface of the elevation adjustment screw changes by one quarter of the pitch of the threads of the threaded portion of the elevation adjustment screw.

4. The diopter rear sight of claim 1, wherein the drum arm is laterally adjustable with respect to the housing.

5. The diopter rear sight of claim 4, further comprising a lateral adjustment screw, wherein the drum arm is pivotally mounted on the lateral adjustment screw.

6. The diopter rear sight of claim 1, wherein the elevation adjustment screw has a head surface with detents.

7. The diopter rear sight of claim 5, wherein the lateral adjustment screw has a head surface with detents.

8. The diopter rear sight of claim 1, wherein the elevation adjustment screw has a head surface resting on the housing.

9. The diopter rear sight of claim 1, wherein the elevation adjustment screw has a convex head surface.

10. The diopter rear sight of claim 1, further comprising the sight drum having a plurality of apertures located at different elevations.

11. The diopter rear sight of claim 1, further comprising a clamp attached to the housing, wherein the clamp is adapted to engage a firearm accessory rail.

12. A diopter rear sight comprising:

a housing;

a drum arm pivotably connected to the housing;

an elevation adjustment screw rotatably engaged with the drum arm; and a sight drum rotatably engaged to the elevation adjustment screw.

13. The diopter rear sight of claim 12, wherein the sight drum is threadedly connected to the elevation adjustment screw.

14. The diopter rear sight of claim 12, wherein the drum arm is laterally adjustable with respect to the housing.

15. The diopter rear sight of claim 14, further comprising a lateral adjustment screw, wherein the drum arm is pivotally mounted on the lateral adjustment screw.

16. The diopter rear sight of claim 12, wherein the elevation adjustment screw has a head surface with detents.

17. The diopter rear sight of claim 15, wherein the lateral adjustment screw has a head surface with detents.

18. The diopter rear sight of claim 12, wherein the elevation adjustment screw has a head surface resting on the housing.

19. The diopter rear sight of claim 12, wherein the elevation adjustment screw has a convex head surface.

20. The diopter rear sight of claim 12, further comprising the sight drum having a plurality of apertures located at different elevations.

21. The diopter rear sight of claim 12, wherein the elevation adjustment screw has a head surface, and wherein a distance between the sight drum and the head surface of the elevation adjustment screw changes as the sight drum is rotated.

22. The diopter rear sight of claim 21, wherein the sight drum has a threaded aperture having a thread pitch that receives the elevation adjustment screw.

23. The diopter rear sight of claim 22, wherein responsive to the sight drum turning one quarter turn about its axis, the distance between the sight drum and the head surface of the elevation adjustment screw changes by one quarter of the thread pitch of the threaded aperture.

24. The diopter rear sight of claim 12, further comprising a clamp attached to the housing, wherein the clamp is adapted to engage a firearm accessory rail.

* * * * *